US005626245A

United States Patent [19]

Kokenge et al.

[11] Patent Number: 5,626,245

[45] Date of Patent: May 6, 1997

[54] ANCHOR FOR SECURING WIRE SHELVING, SHELVING SYSTEM, AND FASTENER FOR SAME

[75] Inventors: John D. Kokenge, Bloomington, Ind.; F. A. Backscheider, Batavia, Ohio; Steven Egolf, Bloomington, Ind.; Elmer J. Kokenge, Loveland, Ohio

[73] Assignee: Schulte Corporation, Cincinnati, Ohio

[21] Appl. No.: 378,282

[22] Filed: Jan. 27, 1995

[51] Int. Cl.[6] ..... A47F 5/00

[52] U.S. Cl. ..... 211/90

[58] Field of Search ..... 211/90, 106; 248/497, 248/498, 222.11, 222.12; 411/387; 108/107

[56] References Cited

U.S. PATENT DOCUMENTS

| | | | |
|---|---|---|---|
| 1,907,495 | 5/1933 | Brunski | 248/497 |
| 3,431,813 | 3/1969 | Johnson . | |
| 3,911,516 | 10/1975 | Einhorn | 248/497 |
| 3,995,821 | 12/1976 | Einhorn | 248/497 |
| 4,361,099 | 11/1982 | Kokenge et al. . | |
| 4,601,625 | 7/1986 | Ernst et al. . | |
| 4,708,552 | 11/1987 | Bustos et al. . | |
| 4,763,456 | 8/1988 | Giannuzzi . | |
| 4,892,429 | 1/1990 | Giannuzzi . | |
| 5,039,262 | 8/1991 | Giannuzzi . | |
| 5,160,225 | 11/1992 | Chern . | |
| 5,188,496 | 2/1993 | Giannuzzi . | |
| 5,190,425 | 3/1993 | Wieder et al. . | |
| 5,224,805 | 7/1993 | Moretti et al. . | |
| 5,234,299 | 8/1993 | Giannuzzi . | |
| 5,267,423 | 12/1993 | Giannuzzi . | |
| 5,308,203 | 5/1994 | McSherry et al. . | |

*Primary Examiner*—Alvin C. Chin-Shue
*Assistant Examiner*—Sarah L. Purol
*Attorney, Agent, or Firm*—Dinsmore & Shohl LLP

[57] ABSTRACT

An anchor for securing wire shelving and the like to a wall is provided, the anchor comprises:

a spool-like head comprising a front portion, a rear portion, and an intermediate semi-circular arcuate groove extending about the entire circumference of the head, such that a portion of the wire shelving may be secured in the groove, and a means for securing the head to a wall structure.

A shelving system employing this anchor is also provided, as well as a support plate/fastener combination for use in this shelving system. The support plate employs a semi-circular aperture which provides additional securing of the fastener.

28 Claims, 5 Drawing Sheets

ANCHOR FOR SECURING WIRE SHELVING, SHELVING SYSTEM, AND FASTENER FOR SAME

BACKGROUND OF THE INVENTION

1. Field of the Invention

The present invention relates to an anchor for securing wire shelving to a wall, as well as a shelving system and a fastener suitable for use with the same. More specifically, the anchor of the present invention greatly simplifies the securing of wire shelving to a wall, and the associated fastener provides a simple means of securing various support brackets for the wire shelving to the walls. The fastener may also be used in any of a number of other applications, particularly when used in conjunction with a support plate having an aperture of an appropriate configuration.

2. Description of Prior Art

The use of wire shelving has become a viable, low-cost alternative to traditional wood shelving. This wire shelving generally consists of a number of parallel-spaced, transversely-extending, cold drawn steel wires welded to one or more longitudinally extending support wires. The shelving may be provided in a wide variety of lengths, widths and styles, and is typically secured to the adjacent support walls by means of a number of well-known mounting devices or fasteners. One type of mounting apparatus is shown in U.S. Pat. No. 4,361,099, which is herein incorporated by reference.

One important consideration in the design of wire shelving is the ease of installation. Since such shelving may often be installed by relatively unskilled homeowners, or by building contractors desiring to cut installation time as much as possible, the mounting devices employed must be relatively simple and quick to install. In addition, the mounting devices should be capable of securing the wire shelf to dry wall having a thickness of ½ inch or greater. Many of the previous designs, however, require the use of multi-part fasteners for securing the shelving and various brackets to the support walls. In addition, many of these fasteners require the installer to carefully align the fastener so as to ensure proper support of the wire shelving. Thus, there is a need for a simple mounting apparatus for attaching wire shelving to adjacent support walls, as well as a shelving system utilizing simple fasteners for securing the various support brackets.

SUMMARY OF THE INVENTION

It is an object of the present invention to provide an anchor for securing wire shelving to a wall.

It is an object of the present invention to provide an anchor for securing wire shelving to a wall.

It is another object of the present invention to provide a shelving system which utilizes an easily installed anchor for securing the shelf to a wall.

It is yet another object of the present invention to provide a support plate/fastener combination which may be used to secure a wire shelf to dry wall or similar substrate, and which may also be used to secure various other types of apparatus to dry wall and similar substrates.

The forgoing objects can be accomplished by providing, in accordance with one aspect of the present invention, an anchor for securing wire shelving and the like to a wall, said anchor comprising:

a spool-like head comprising a front portion, a rear portion, and an intermediate semi-circular arcuate groove extending about the entire circumference of said head, such that a portion of said wire shelving may be secured in said groove, and a means for securing said head to a wall structure.

The anchor also preferably comprises a bore extending through said head. The means for securing said head to a wall structure may comprise a threaded shank extending perpendicularly away from said rear portion, wherein said threaded shank comprises a screw inserted through said bore, said screw having a head and a shaft, said bore further comprising a shoulder sized to permit passage of said shaft of said screw through said bore, while not permitting the head of said screw to pass through said bore.

Alternatively, the threaded shank may comprise the combination of a threaded portion and a drilling portion, said threaded portion positioned adjacent said rear portion of said head, thereby providing a self-drilling anchor. The threaded portion may comprise a cylindrical body having a continuous thread extending therefrom, said thread tapering in size in the direction from said front plate towards said drilling portion. While the drilling portion may comprise a flat blade extending from said cylindrical body, said blade having, at an end positioned distally of said body, a central guide point and a boring point on either side of said guide point. In addition, the bore preferably comprises a phillips head recess extending through said head and at least partially through said cylindrical body in order to permit the user the secure the anchor to dry wall by means of a powered screwdriver.

A shelving clip may also be provided to help secure the wire within said arcuate groove. The shelving clip may comprise:

(a) a head;

(b) a rod extending away from said head, said rod insertable in said bore;

(c) a lock tab extending tangentially away from said head above said rod, said tab having an arcuate recess on its underside, such that when said rod is inserted into said bore, said arcuate recess will be positioned directly above said arcuate groove.

Further support may be provided by a flexible rear locking ridge positioned about the circumference of said rear portion of said head and extending inwardly into said groove, said locking ridge shaped so as to lock said wire shelving within said groove. A front locking ridge is also preferable and provides additional support. In combination with the locking ridges, a plurality of radially extending slits (or cuts) may be provided on the rear portion of the head, said slits extending radially inward from the outer circumference of said rear portion towards said bore.

The foregoing objects may also be accomplished by providing a shelving system for attachment to a wall, said system comprising:

(a) a shelf comprising a plurality of interconnected wire members; and (b) at least one anchor of the type described above for securing said shelf to said wall, said anchor sized so that one of said wire members may be securely held within said arcuate groove of said anchor.

The shelving system may further comprise an end bracket for securing a front end of said shelf to a vertically extending side wall, said end bracket comprising a rear support plate having at least one support aperture formed therein, and a fastener insertable in said support aperture, said fastener having a head larger in diameter than said support aperture, and said fastener securable to said side wall. The fastener is preferably self-drilling, and comprises:

(a) a drilling portion;

(b) a cylindrical body having a continuous thread extending therefrom, said body secured to said drilling portion;

(c) a head secured to said body at an end opposite said drilling tip; and (d) a phillips head recess extending through said head and a portion of said cylindrical body.

The shelving system may also comprise a support brace for supporting the front edge of said shelf, said support brace comprising:

(a) a rigid brace member, and angularly disposed tab member attached at one end of said brace member, said tab member having at least one support aperture formed therein;

(b) at least one clip at the opposite end of said support brace, said clip attachable to the front end of said shelf; and (c) a fastener insertable in said support aperture, said fastener being of the type described above.

Finally, a support plate/fastener combination for attaching an apparatus (such as a shelf, light fixture, etc.) to dry wall and similar substrates is provided, said combination comprising:

(a) a self-drilling fastener comprising:

a drilling portion;

a cylindrical body having a continuous thread extending therefrom, said body secured to said drilling portion;

a head secured to said body at an end opposite said drilling tip; and a phillips head recess extending through said head and a portion of said cylindrical body;

and (b) a support plate having front and rear surfaces, a semi-circular support aperture communicating between said front and rear surfaces, and an arcuate bracing plate which extends into said support aperture, wherein said support aperture has a diameter less than that of the head of said fastener, and wherein the arc-length of said bracing plate is selected so as to permit said the thread of said fastener to freely rotate through said support aperture without interference from said bracing plate.

The bracing plate preferably has first and second interior curved surfaces positioned within said support aperture, said first interior curved surface angled inwardly from said front surface of said front surface of said support plate, and said second interior curved surface positioned perpendicular to said rear surface of said support plate. The curvature of said first interior surface of said bracing plate preferably corresponds substantially to the curvature of said cylindrical body adjacent the head of said fastener.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF THE INVENTION

Reference will now be made in detail to the presently preferred embodiments of the invention, examples of which are illustrated in the accompanying drawings, wherein like numerals indicate the same elements throughout the views.

Figure 1:
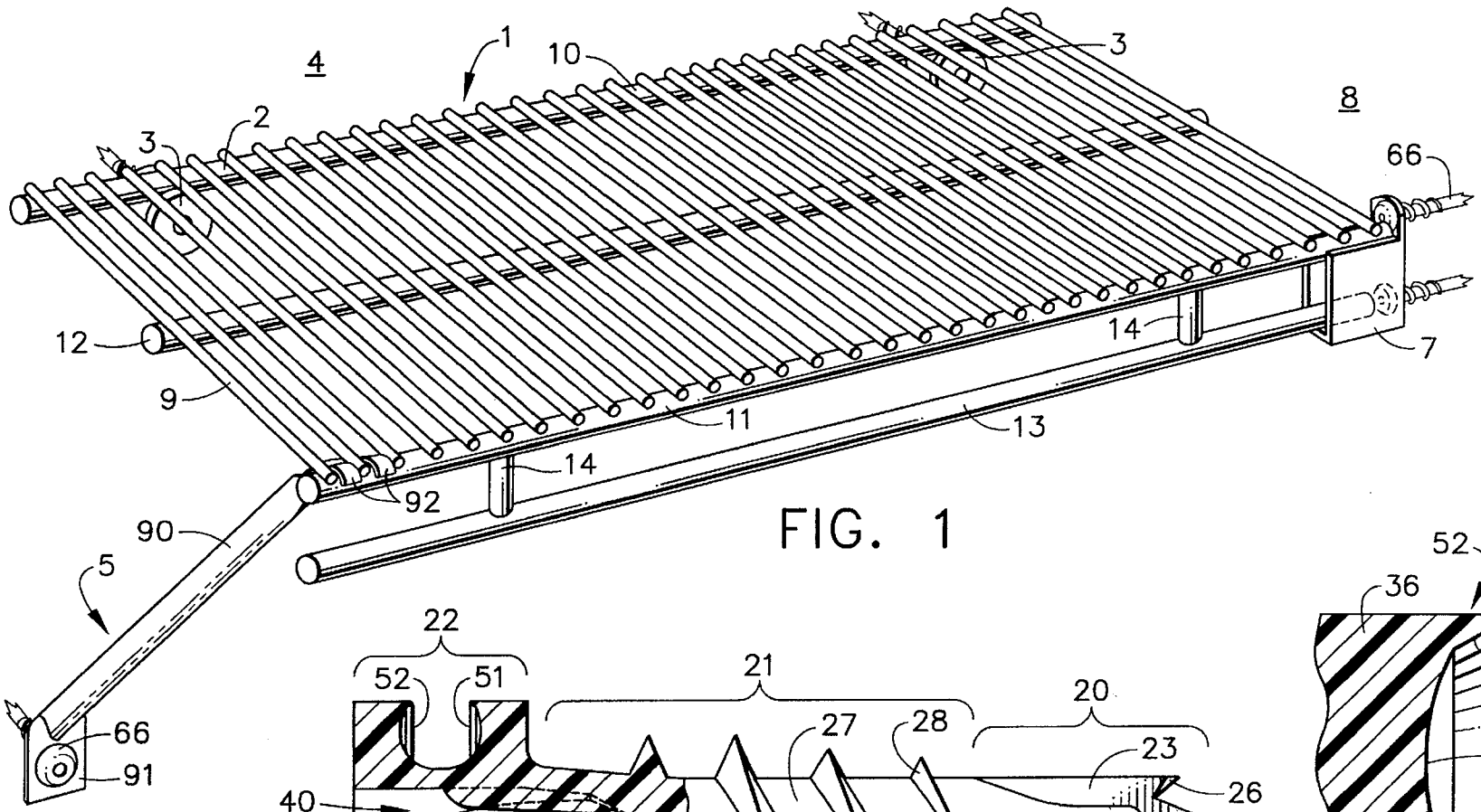
FIG. 1 is front perspective view of a shelving system according to the present invention.

The shelving system of the present invention is illustrated generally at 1 in the perspective view of FIG. 1, and includes a horizontally mounted shelf 2, a plurality of spaced anchors 3 for securing the rear edge of shelf 2 to a rear vertical wall surface 4, an angularly extending support brace 5 for supporting the front edge of shelf 2 to rear wall surface 4 by means of a fastener 6, and an end bracket 7 for supporting the forward corner of shelf 2 on a vertical side wall surface 8 adjoining rear wall surface 4. In general, rear wall 4 and side wall 8 will be of a dry wall construction having a thickness of ½ inch or greater, such as that typically found in a home. Shelving system 2 will typically be mounted in a closet or other confined space, and thus an additional end bracket 7 may be provided for supporting the opposite forward corner of shelf 2. Depending upon the size of shelf 2 and its intended use, it may also not always be necessary to include both a support brace 5 and an end bracket 7. Likewise, additional anchors 3 and support braces 5 may also be employed in order to provide additional support for shelf 2.

While shelf 2 is merely exemplary of a number of different shelving configurations which may be employed with one or more aspects of the present invention, shelf 2 includes a plurality of transversely-extending parallel-spaced wire members, one of which is shown at 9, which forms the horizontal-supporting surface of shelf 2. Wire members 9 are supported at their rear ends by means of a somewhat larger, generally cylindrical, longitudinally-extending rear support wire 10. Similarly, the forward ends of transverse wire members 9 are supported by means of a longitudinally-extending, generally cylindrical front support wire 11. Additional support wires such as wire 12 may also be provided along the undersurface of wire member 9 between rear support wire 10 and front support wire 11. In addition, a lower front support wire 13 vertically-spaced below front support wire 11 is attached thereto by a pair of spaced vertically extending hanger wires 14. As will be more fully understood below, various other configurations may be employed for shelf 2, and anchors 3 of the present invention may effectively be employed with any wire shelf having an appropriately-sized rear support wire 10 extending across at least a portion of its rear edge.

The wire members forming shelf 2 may be constructed of a number of materials, including cold drawn steel rod or other rigid material, and may be joined by resistance welding or the like. In addition, the surfaces of the shelf may be coated with a hard, non-porous, durable surface such as epoxy or the like. It will be noted that the upper surface of shelf 2 provides a convenient horizontally-oriented storage location for articles, while lower front support wire 13 provides a convenient support for clothes hangers and the like.

The rear edge of shelf 2 formed by rear support wire 10 is supported at a plurality of spaced locations by means of anchors 3. Anchors 3 provide a simple and quick means of securing rear support wire 10 to rear wall 4, and will be described in greater detail below. Support brace 5 attaches to, and supports, front support wire 11, and angularly extends from wire 11 to rear wall surface 4 where it attaches thereto. Support brace 5 is preferably attached to wall 4 by means of fastener 66, to be described in further detail herein. End bracket 7 preferably cradles, and thereby supports, a forward corner of shelf 2, and is secured to vertical side wall 8 by means of at least one, and preferably two, fasteners 66.

The details of the construction of end bracket 7 are shown in greater detail in FIGS. 9–12. While support aperture 76 will be described in greater detail in conjunction with the description of fastener 66, end bracket 7 generally comprises rear support plate 75 having a rear surface configured to abut the front face of side wall 8. A pair of spaced parallel vertical flange portions 85 and 86 extend forwardly from the outer edges of rear support plate 75. A horizontally-extending floor member 87 is supported along its rear and side edges by support plate 75 and vertical flange portions 85 and 86. Floor member 87 is positioned so as to support lower front support rod 13 as shown in FIG. 1. It should be noted that end bracket 7 is shown in FIG. 1 as having a slightly different configuration than that of FIG. 11. The only distinction, is that the lower-most support aperture 76 is positioned above floor member 87 in FIG. 11, while in FIG. 1 it is positioned below floor member 87. It will be noted, that end bracket 7 of both FIG. 1 and FIG. 11 essentially cradle a front comer of shelf 2, and support lower front support wire 13 on its underside. As will be apparent, this offers additional support in the shelving system of FIG. 1.

Figure 17:
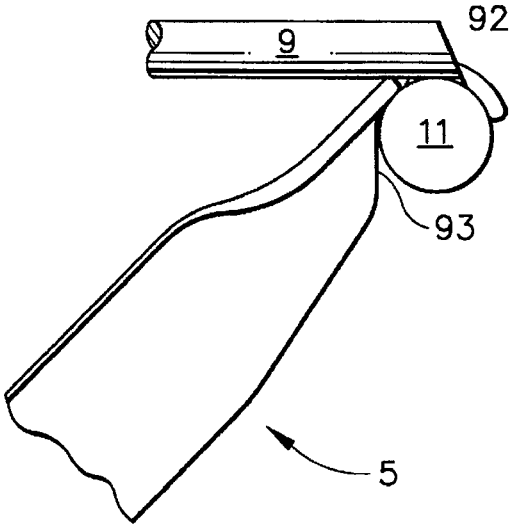
FIG. 17 is an enlarged view of a portion of the shelving system of FIG. 1, more clearly showing the support brace.

As shown in FIG. 1, the forward edge of shelf 2 is supported from rear wall 4 by means of support brace 5. Support brace 5 comprises a rigid channel-shaped brace number 90 terminating at its lower end in a flat angularly disposed tab member 91 (i.e., a "support plate") for mounting its brace member to vertical wall surface 4 such that the brace extends upwardly and forwardly between the wall and forward edge of shelf 2 at an angle of approximately 45°. Tab member 91 contains an aperture similar in configuration to support aperture 76 on end bracket 7. This aperture in tab member 91 will permit the effective use of fastener 66. The upper end of brace member 90 terminates in a pair of spaced arcuate clips 92 for attaching support brace 5 to front support wire 11. The configuration of clips 92 is not critical, and an exemplary embodiment is shown in FIG. 17. As shown in FIG. 17, since anchors 3 will secure the rear edge of shelf 2, the front edge of shelf 2 may tend to rotate downwardly towards wall 4. Thus, brace member 90 has support edge 93 positioned to abut against front support wire 11. When clips 92 are secured about front support wire 11, and tab member 91 is secured to wall 4, support surface 93 will prevent rotation of the front edge of shelf 2. In this fashion, support brace 5 will act to support and secure the front edge of shelf 2.

As best shown in FIGS. 2–7, anchor 3 comprises drilling portion 20, threaded portion 21, and head 22. Drilling portion 20 preferably comprises a flat blade 23 having, at one end, a central point 24, and first and second boring points 25 and 26, respectively, positioned on either side of said central guide point 24. Central point 24 preferably extends beyond first and second boring points 25 and 26, and acts as a guide when anchor 3 is drilled into dry wall or another substrate. When anchor 3 is rotated and urged into the dry wall in the direction of central point 24, first and second boring points 25 and 26 will form a bore through the dry wall in a fashion identical to that of a standard drill bit. As will be apparent, drilling portion 20 is similar in construction to that shown in U.S. Pat. No. 4,601,625, which is herein incorporated by reference. Drilling portion 20, however, can be of any of a number of alternative configurations, since its only purpose is to bore through the dry wall to which anchor 3 is being secured. Thus, the drilling portion shown in U.S. Pat. No. 5,038,262, which is herein incorporated by reference, may also readily be employed in the present invention.

Figure 2:
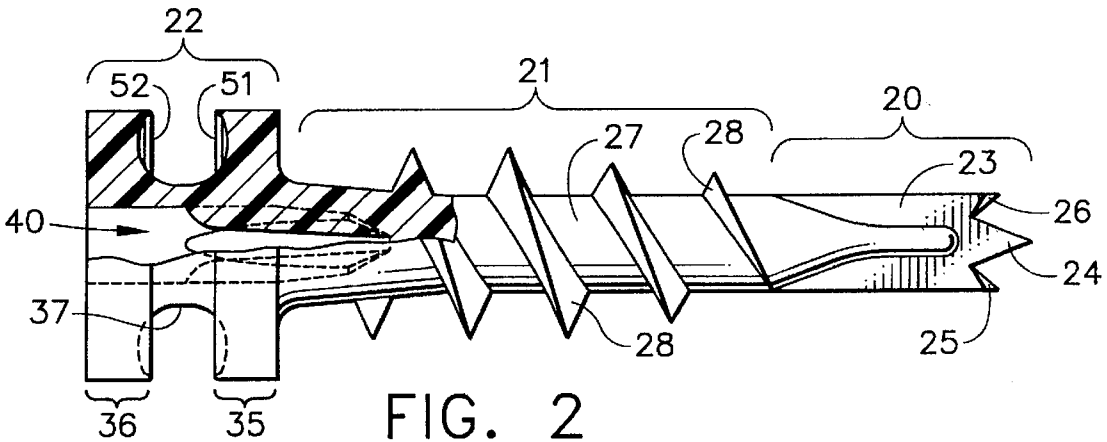
FIG. 2 is a partially cut-away view of the anchor according to the present invention.

Threaded portion 21 of anchor 3 comprises a cylindrical body 27 having a continuous thread 28 extending therefrom. As shown in FIG. 2, thread 28 tapers in diameter towards drilling portion 20, such that thread 28 has its smallest diameter adjacent drilling portion 20. As will be understood, this facilitates the forming of a corresponding thread in the dry wall. The term diameter is intended to mean twice the distance from the center line of cylindrical body 27 to thread 28. As shown in FIG. 2, the portion of thread 28 located nearest head 22 may be of an approximately equal diameter, while the thread nearest drilling portion 20 tapers significantly. In other words, the diameter of thread 28 may remain approximately constant for several revolutions, and only decreases in size for the few revolutions located adjacent drilling portion 20. As anchor 3 is rotated and urged in the direction of central point 24, thread 28 will cut a corresponding thread in dry wall 29 (see FIG. 5), thereby securing anchor 3 in dry wall 29. Since thread 28 has a significant number of revolutions about cylindrical body 27, anchor 3 may be used in a variety of dry wall thicknesses. In fact, anchor 3 may be employed in dry wall having a thickness of up to ⅝", whereas previous products could only be employed in ½" thick dry wall.

As is also apparent from FIG. 2, cylindrical body 27 preferably tapers slightly along its length, and thus its diameter is greatest at the point where it meets head 22. This tapering will enhance the rigidity of the shelving system, since the larger diameter for cylindrical body 27 at head 22 will tend to compress the dry wall slightly. More preferably, the taper of cylindrical body 27 only exists for a short distance away from head 22, as shown in FIG. 2. As also shown in FIG. 2, and as will be readily apparent, cylindrical body 27 also preferably tapers at its opposite end, since drilling portion 20 preferably comprises flat blade 23. In order to facilitate the molding of anchor 3, the transition from cylindrical body 27 to flat blade 23 must be as smooth as possible, and thus the configuration shown in FIG. 2 is preferred. Cylindrical body 27, therefore, preferably tapers in a cone-like fashion into flat blade 23. This cone-like taper of cylindrical body 27 is indicated as 30 in FIG. 5, and the diameter of cone-like taper 30 preferably decreases to the thickness of flat blade 23.

Figure 5:
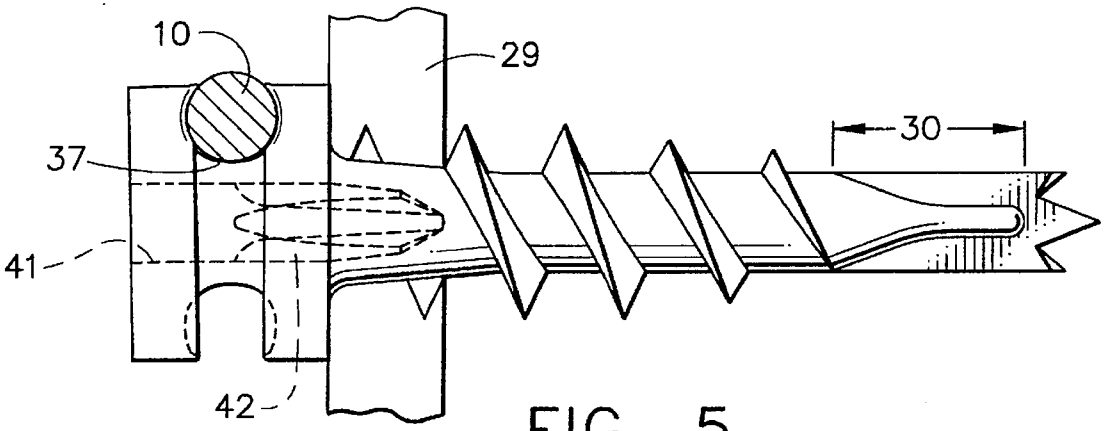
FIG. 5 is a side view of the anchor of the present invention installed in dry wall.

Head 22 is attached to the end of cylindrical body 27 opposite the end to which drilling portion 20 is attached. As shown in the figures, head 22 is spool-like in nature, having a front portion 35, a rear portion 36, and an intermediate arcuate groove 37 which extends about the entire circumference of head 22. Preferably, front and rear portions 35 and 36 are cylindrical in nature. As will be understood from FIGS. 1 and 5, rear support wire 10 may be inserted into, and thereby securely held within, groove 37. It is preferable that groove 37 have an arcuate cross-section which circularly extends more than 180 degrees, and that the diameter of arcuate groove 37 be slightly smaller than that of rear support wire 37 in order to ensure that rear support wire 10 is securely held within groove 10. As shown in FIG. 5, rear support wire 10 will thereby be snugly positioned within arcuate groove 37. One of the principle advantages of anchor 3 is that, since arcuate groove 37 extends around the entire circumference of head 22, there is no need to rotatingly align anchor 3. The installer must merely ensure that anchor 3 is attached to wall 4 at the appropriate level, since rear support wire 10 may be secured within arcuate groove 37 at any point about the circumference of head 22. It is also preferable that the arcuate groove not extend too far circumferentially, as the configuration shown ensures that anchor 3 may even be employed directly beneath a transverse wire member 9.

As mentioned previously, anchor 3 is secured to dry wall or another substrate by rotating anchor 3 while simultaneously urging anchor 3 into the dry wall in the direction of central point 24. This is generally accomplished by use of an electric screwdriver, however a manually operated screwdriver could at times be employed. In order to facilitate the use of a screwdriver, phillips head recess 40 is provided. As shown in FIG. 2, phillips head recess 40 preferably extends completely through the center of head 22 and partially through cylindrical body 27. Recess 40 essentially comprises a bore 41 extending partially through anchor 3, and four triangular aligning ridges 42 positioned about the interior circumference of bore 41 at 90° intervals. Ridges 42 are designed to matingly engage the corresponding blades of a phillips head screwdriver. In this fashion, the phillips head screwdriver (which is preferably attached to a hand-held motor drive unit) is inserted into phillips head recess 40. When the screwdriver is rotated and force is applied against anchor 3, drilling portion 20 of anchor 3 will create a bore in the dry wall or other substrate being drilled. Once a bore is created, thread 28 will then form a corresponding thread structure in the dry wall. Since head 22 is larger in diameter than the largest portion of thread 28 and drilling portion 20, anchor 3 will not advance further into the dry wall once head 22 abuts dry wall 29. In order to ensure that anchor 3 will not continue to rotate once head 22 abuts dry wall 29 and thereby "strip" the corresponding threads formed in the dry wall, the clutch on the powered screwdriver is preferably set to ensure that rotation will cease when head 22 abuts dry wall 29. Once anchor 3 is secured in this fashion rear support wire 10 may then be downwardly urged into groove 37, as shown in FIGS. 1 and 5, and thereby held in place.

While the installer of the shelving system will make every effort to ensure that anchor 3 is not drilled into dry wall 29 at the location of a stud member, at times this will be unavoidable. On these occasions, drilling portion 20 will still easily bore through dry wall 29, however, the boring operation will rather abruptly come to a halt when drilling portion 20 reaches a stud. On these occasions, the installer will then remove anchor 3, and replace the phillips head screwdriver with a drill bit corresponding in size to drilling portion 20. The user then bores through the dry wall at a location corresponding to the bore previously established in dry wall 29 using the drill bit. Once this bore is completed, the installer will once again use anchor 3 and continue the securing operation in the same fashion as previously described. Thread 28 on anchor 3 is capable of creating a corresponding thread in a stud member, as long as a bore corresponding in diameter to drilling portion 20 has been previously established in the stud member. It should be noted that it will not usually be necessary to use a new anchor 3, since the original operation in which drilling portion 20 strikes the stud will only damage the drilling portion (which is no longer needed).

Figure 14:
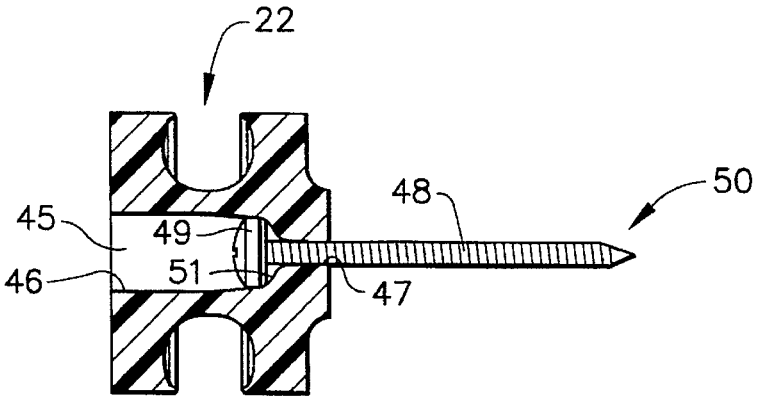
FIG. 14 depicts an alternative embodiment of an anchor according to the present invention.

An alternative when a stud member is present in the desired location is shown in FIG. 14. In this instance, drilling portion 20 and threaded portion 21 have been removed, and only head 22 remains. This may be accomplished in one of two manners. As shown in FIG. 14, head 22 may be singularly molded without a drilling portion and a thread portion. Once again, a bore 45 is provided in head 22, however in this instance bore 45 has a first portion 46 sized so as to permit passage of both the shank 48 and head 49 of a screw 50 which is inserted into bore 45 as shown. Second portion 47 of bore 45, however, is sized so as to permit passage of only shank 48 of screw 50, and thus movement of head 49 is restricted by shoulder 51 of bore 45. In this manner, head 22 may be secured to dry wall 29 at a stud member by merely drilling screw 50 into the dry wall member thereby rigidly securing head 22 in the desired location. As an alternative to FIG. 14, the installer may merely cut anchor 3 at the point where threaded portion 21 attaches to head 22. A screw may then be inserted into bore 40 in an identical manner to that shown in FIG. 14. In this instance, however, ridges 42 provided in phillips head recess 40 will limit movement of head 49 of screw 50. While the drilling operation described above may tend to compress ridges 42, since head 22 is preferably made of plastic this compression of ridges 42 will act to provide even more obstruction beneath head 49, thereby preventing head 49 from passing completely through head 22.

Figure 3:
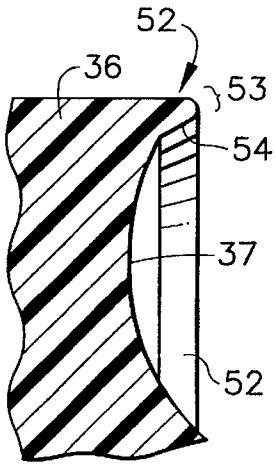
FIG. 3 is an enlarged cut-away view of the front portion of the anchor head according to the present invention.

In order to securely hold rear support wire 10 in arcuate groove 37 of anchor 3, applicants have found that it may be necessary to provide additional securing structures. Thus, as best shown in FIGS. 2 and 3, front and rear locking ridges 51 and 52 respectively are provided about the circumference of head 22 at the points where front portion 35 and rear portion 36 meet arcuate groove 37. In other words, front and rear locking ridges 51 and 52 can be seen as extensions of front portion 35 and rear portion 36, respectively, wherein these extensions extend into arcuate groove 37.

It will also be noted that ridges 51 and 52 are not mere continuations of arcuate groove 37. As best shown by FIG. 3, rear locking ridge 52 generally comprises semi-circular portion 53 which extends from the outer surface of rear portion 36, and tangent surface 54 which extends tangentially from semi-circular portion 53 to the surface of arcuate groove 37. While the exact dimensions of front and locking ridges may vary depending upon the material chosen for the construction of anchor 3, it is presently preferred that tangent surface 54 be positioned at an angle of approximately 120° from an imaginary tangent line extending vertically upward from semi-circular portion 53. Front locking ridge 51 is preferably of a similar construction to that of rear locking ridge 52. In addition, as shown in FIGS. 2 and 3, both front and rear locking ridges 51 and 52 preferably extend about the entire circumference of head 22.

Figure 13:
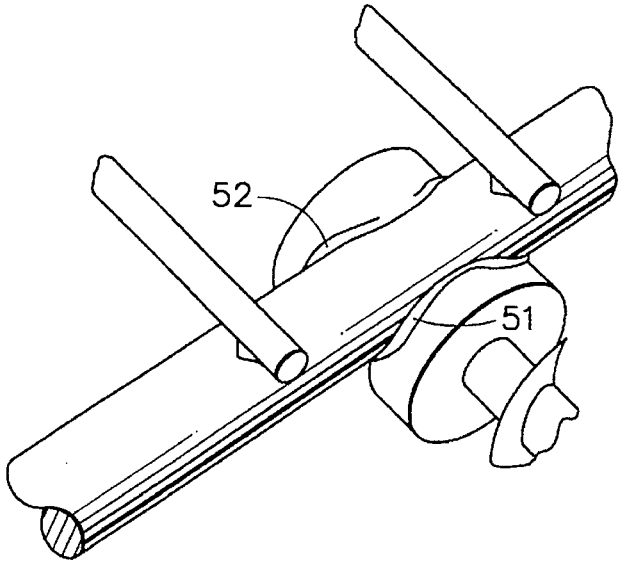
FIG. 13, is a perspective view showing the manner in which a wire member is secured within the arcuate groove of the anchor.

FIGS. 5 and 13 best illustrate the manner in which front and rear locking ridges 51 and 52 enhance the holding properties of anchor 3. When rear support wire 10 is inserted into groove 37, front and rear locking ridges 51 and 52, being flexible in nature, will partially mold themselves about rear support wire 10 in the fashion shown in FIG. 13. In other words, because groove 37 is only semi-circular in nature, only a portion of rear support wire 10 will be positioned within groove 37. While extending groove 37 to more completely form a circle would certainly provide a more rigid means of holding rear support wire 10, this is obviously not viable since it would be difficult or impossible for the installer to urge wire 10 into groove 37. While the construction for groove 37 shown in the figures permits the user to easily urge wire 10 into the groove, the arcuate extent of groove 37 may permit wire 10 to pop out of the groove due to flexing of front and rear portions 35 and 36. Front and rear locking ridges 51 and 52 overcome this problem, in that both tend to flex over a portion of wire 10 which is positioned outside of groove 37 (as best shown in FIG. 13). As also shown in FIG. 13, however, the portion of front and locking ridges 51 and 52 positioned beneath support wire 10 will tend to flex inwardly into groove 37 thereby permitting wire 10 to be securely held within groove 37. An additional advantage of front and rear lock in ridges 51 and 52 is that as rear support wire 10 is urged into groove 37, a noticeable pop will be both felt and heard by the installer, thereby providing an indication that wire 10 is properly seated within anchor 3.

Figure 15:
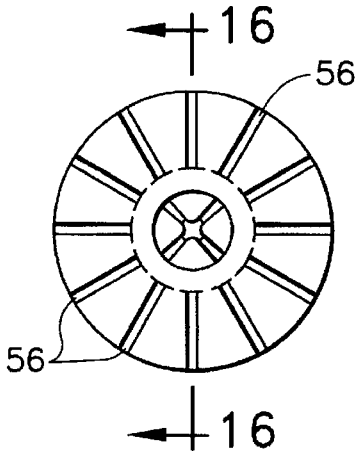
FIG. 15 depicts yet another alternative embodiment for the head of the anchor of the present invention.
Figure 16:
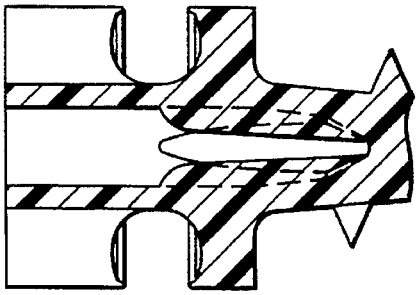
FIG. 16 is a cut-away view taken along line 16—16 of FIG. 15.

FIG. 15 provides an alternative construction which offers similar advantages. In this embodiment, a plurality of radial cuts are made in rear portion 36 of head 22. These radial cuts 56 extend completely through rear portion 36 into groove 37. Radial cuts 56, however, extend radially inward only partially to phillips head recess 40. When radial cuts 56 are employed, front and rear locking ridges 51 and 52 are preferably more substantial than that shown in FIG. 3, but may be of similar configuration. This will provide stiffer locking ridges 51 and 52. When radial cuts 56 are then provided, the portion of locking ridge 52 which is located on the area of rear portion 36 nearest the uppermost portion of wire 10 (i.e., a pie-shaped section of rear portion 36) will be positioned over top of the adjacent portion of wire 10. The two pie-shaped sections of rear portion 36 on either side will then bow outwardly in order to permit full insertion of wire 10. This will in turn enhance the securing properties of groove 37. As shown in FIG. 16, which is a cross-sectional view of the embodiment of FIG. 15, it is usually necessary to increase the thickness of rear portion 36 slightly when radially cuts 56 are employed in order to properly enhance the securing properties of anchor 3.

Figure 7:
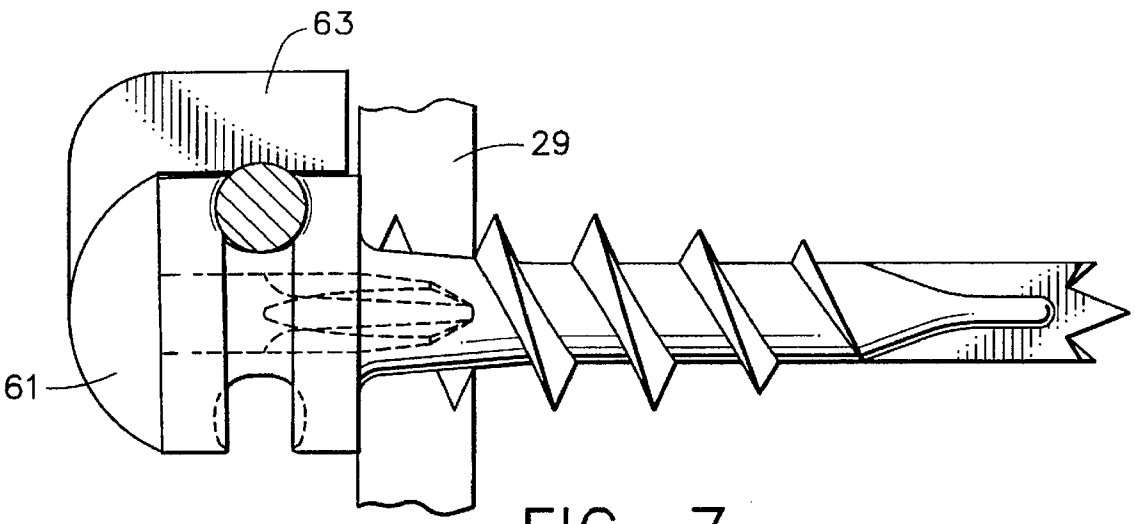
FIG. 7 is a side view showing an anchor installed in dry wall with the shelving clip attached.
Figure 4:
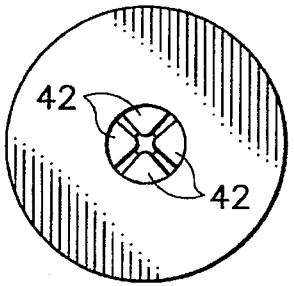
FIG. 4 is an end view of an anchor head.
Figure 6:
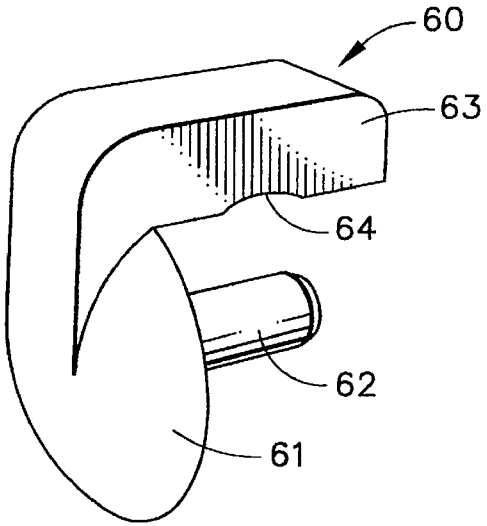
FIG. 6 is a perspective view of a shelving clip of the present, invention.

In order to further enhance the securing of wire 10 within groove 37, shelving clip 60 (as shown in FIG. 6 and 7) may also be provided. Shelving clip 60 is particularly useful when an end of shelf 2 will not be supported in an end bracket, since anchor 3 nearest such open end will be subjected to twisting forces which may tend to cause wire 10 to pop out of groove 37 of the anchor. Shelving clip 60 comprises a dome-shaped head 61, rod 62 extending perpendicularly away from head 61, and lock tab 63 extending tangentially away from the outer circumference of head 61. Rod 62 is insertable within phillips head recess 40 of anchor 3, and is sized so that dome-shaped head 61 will rest flush against rear portion 36 of anchor 3. As shown in FIG. 6, the tip of rod 62 is also preferably slightly tapered to ease the insertability of rod 62 in recess 40. Lock tab 63 is preferably positioned directly above rod 62 and has, on its undersurface, an arcuate recess 64. Arcuate recess 64 is sized and positioned such that when rod 62 is inserted into phillips head recess 40, arcuate recess 64 will snap overtop of a wire 10 held within groove 37 (as shown in FIG. 7). Since the fit of rod 62 and recess 40 is preferably snug, shelving clip 60 will therefore act as a further means of preventing wire 10 from popping out of groove 37.

Figure 8:
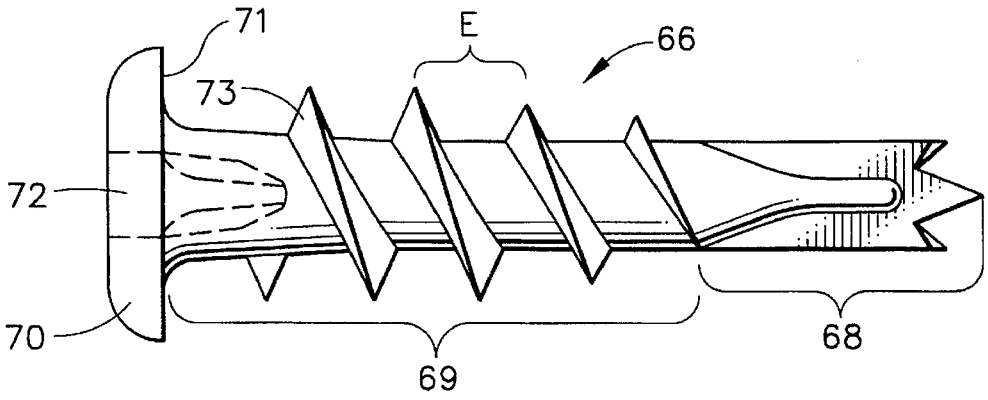
FIG. 8 is a side view of a fastener according to the present invention.
Figure 9:
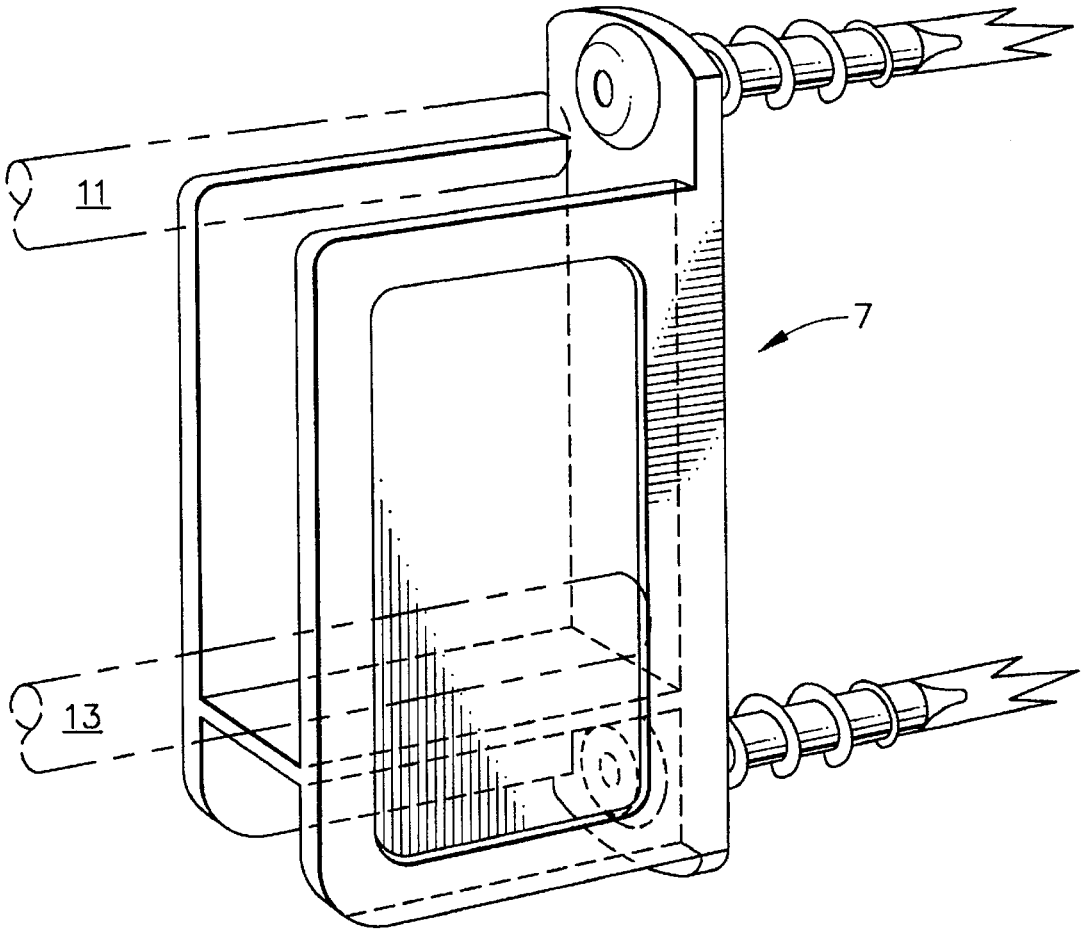
FIG. 9 is a perspective view of an end bracket and accompanying fasteners.

As mentioned previously, the shelving system of the present invention also comprises a support brace and end bracket as shown in FIG. 1. As will be readily apparent, these two support devices must somehow be attached to the corresponding walls. While this can be accomplished by any of a number of well-known means, the present invention also provides a novel fastener which is similar in construction to anchor 3 and therefore can be secured to the dry wall using the same equipment as used for anchor 3. More specifically, fastener 66 is shown in FIG. 8. Similarly to anchor 3, fastener 66 comprises drilling portion 68, threaded portion 69 and head 70. Drilling portion 68 and threaded portion 69 may be as previously described including the alternatives suggested. Head 70 has a flat undersurface 71 designed to rest flush against the surface of an item being secured with fastener 66. For primarily aesthetic reasons, head 70 is preferably of a dome-like configuration. Once again, a phillips head recess 72 extends through head 70 and partially through threaded portion 69. Recess 72, however, need only extend a short distance into threaded portion 69, and preferably extends approximately the same distance into threaded portion 69 as was the case for anchor 3. The critical feature of fastener 66 is that the diameter of head 70 is significantly greater than the greatest diameter of thread 73 on threaded portion 69. This will ensure that fastener 69 will not counter-sink into the dry wall, and will also provide a securing surface to hold the item being fastened in place. This configuration differs considerably from threaded fasteners such as that shown by U.S. Pat. No. 4,601,625, as these prior art fasteners require the additional threading of a screw into the center of the fastener.

Figure 10:
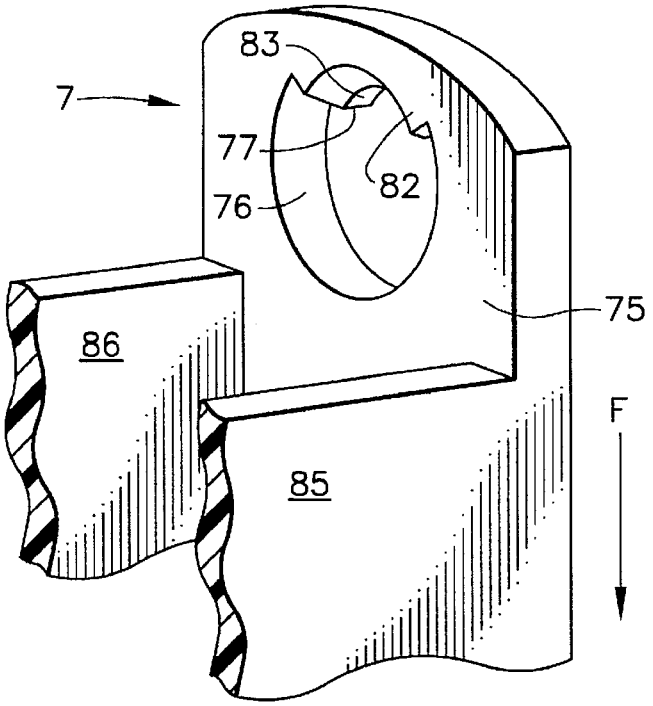
FIG. 10 is an enlarged partial view of the end bracket of FIG. 9.
Figure 11:
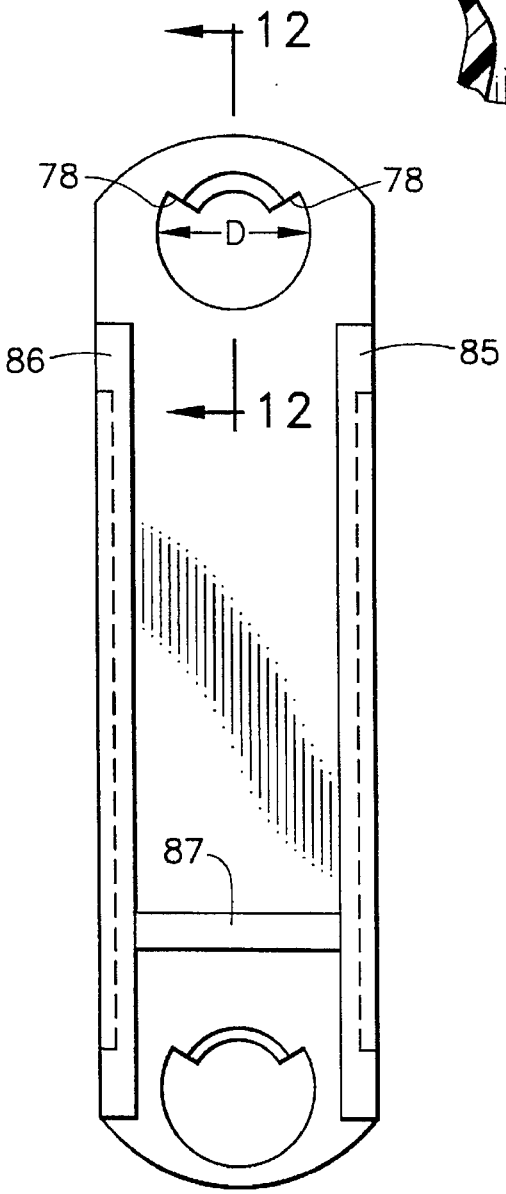
FIG. 11 is an end view of the bracket of FIG. 9.
Figure 12:
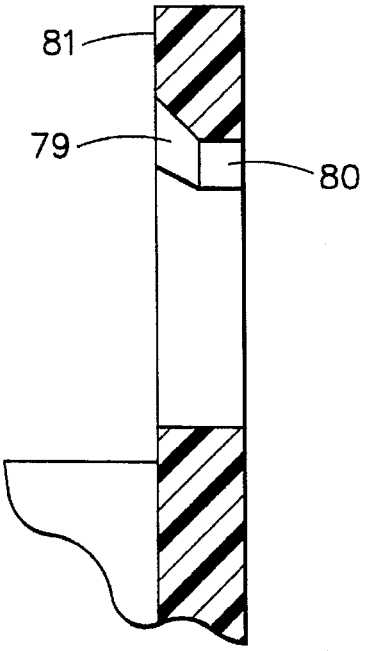
FIG. 12 is an enlarged, cut-away view taken through line 12—12 of FIG. 11.

As mentioned previously, fastener 66 may be conveniently employed to secure support brace 5 and end bracket 7 to the appropriate wall. In order to accomplish this in a rigid fashion, a specially-designed aperture is employed. As shown in FIGS. 10–12, end bracket 7 comprises a rear support plate 75 configured to rest against side wall 8. Rear support plate 75 has a support aperture 76 located therein in order to provide a means for fastening end bracket 7 to side wall 8. Support aperture 76 is generally semi-circular in nature, however arcuate bracing plate 77 extends partially into support plate 76 (it should be noted that the term "semi-circular" is not intended to be limited to structures being exactly ½ of a circle). Side edges 78 of bracing plate 77 extend radially inward towards the central portion of support aperture 76. While the interior surface of support aperture 76 is generally perpendicular to the exterior surface of support plate 75, only a portion of the curved surface of bracing plate 77 positioned within aperture 76 is likewise perpendicular. Thus, as best shown in FIG. 12, first interior curved surface 79 of bracing plate 77 is angled inwardly from the substantially flat front surface 81 of support plate 75. Second interior curved surface 80 of bracing plate 77 is perpendicular to front surface 81 of rear support plate 75.

The purpose of such a configuration for support aperture 76 and bracing plate 77 is that fastener 66 may be threaded through aperture 76 as it is drilled into dry wall. The diameter D of support aperture 76 is only slightly greater than the largest diameter of thread 73 on fastener 66. In addition, the arch length of curved bracing plate 77 is selected so as to permit fastener 66 to still be threaded through aperture 76 without obstruction by bracing plate 77. Thus, as thread 73 begins to enter aperture 76, thread 73 will ride atop surface 81 in the area surrounding point 82 on the exterior surface of bracing plate 77. Since thread 73 proceeds concentrically along the length of threaded portion 69 of fastener 66, thread 73 will ride along the underside of bracing plate 77 in the area surrounding point 83. Therefore, bracing plate 77 will not interfere with the threading of fastener 66 through aperture 76.

Once fastener 66 has been threaded through aperture 76 and is secured within the dry wall, beveled first interior surface 79 of bracing plate 77 will matingly rest against cylindrical body 74 of fastener 66 in the area immediately adjacent to head 70. Since thread 73 terminates before cylindrical body 74 meets head 70, thread 73 will be positioned completely beneath bracing plate 77 and within the dry wall. Since the force on end bracket 7 is in the downward direction shown as F in FIG. 10, beveled first interior surface 79 (whose curvature preferably corresponds substantially to the curvature of the cylindrical body adjacent the head) will be urged against cylindrical body 74, and will thereby more securely hold fastener 66 within support aperture 76, preventing excessive movement of end bracket 7 about fastener 66. This in turn will greatly enhance the rigidity of the shelving system when such an aperture configuration is employed in conjunction with fastener 66. As will be understood, an identical support aperture is provided in support brace 5 at the location wherein fastener 66 holds the support brace against the dry wall.

While fastener 66 has been described in conjunction with the shelving system of the present invention, this fastener may also be used for any of a number of other purposes, particularly when the configuration of support aperture 76 is maintained. Thus, fastener 66 may be employed with any support plate used to secure an item to dry wall or a similar substrate, particularly in conjunction with support aperture 76 having bracing plate 77 as described above. For example, a support plate/fastener combination could be used to hang light fixtures. As will be understood from the previous discussions, the arc-length of bracing plate 77 may be further increased when the thickness of support plate 75 is reduced in relation to the angle of thread 73. In other words, the arc-length of semi-circular bracing plate 77 will depend directly upon the thickness of support plate 75 and the distance E between adjacent revolutions on thread 73 (see FIG. 8). Bracing plate 77 should also be positioned in aperture 76 such that the majority of the force imparted on the support plate (such as that caused by gravity) causes beveled first interior surface 79 of bracing plate 77 to be urged against cylindrical body 74 of fastener 66, thereby increasing the rigidity of the fastening. Based on the foregoing, therefore, the present invention also encompasses a fastener of the type shown in FIG. 8 in conjunction with any support plate having an aperture 76 as described. Keep in mind that the term "support plate" can be used to refer to any support surface, even if formed integrally with the item being supported.

Both anchor 3 and fastener 66 are preferably singularly molded from plastic (i.e., molded as a single part). The plastic material used should be rigid enough to facilitate drilling, while having the flexibility necessary to hold wire 10 within groove 37. While various plastics may be employed, applicants have found that a presently-preferred material is nylon, particularly DuPont Zytel ST801.

The foregoing description of preferred embodiments is by no means exhaustive of the variations of the present inventions that are possible, and has therefore been presented only for purposes of illustration and description. Obvious modifications and variations will be apparent to those skilled in the art in light of the teachings of the foregoing description, and thus it is intended that the scope of the present invention be defined by the claims appended hereto.

What we claim is:

1. An anchor for securing wire shelving to a wall, said anchor comprising:

a spool-like head comprising a front portion, a rear portion, and an intermediate semi-circular arcuate groove extending about the entire circumference of said head, such that a portion of said wire shelving may be positioned in said groove;

a bore extending through said head; and a means for securing said head to a wall structure comprising a threaded shank extending perpendicularly away from said front portion;

wherein said threaded shank comprises a screw inserted through said bore, said screw having a head and a shaft, said bore further comprising a shoulder sized to permit passage of said shaft of said screw through said bore, while not permitting the head of said screw to pass through said bore, wherein said screw may be secured to a wall with said front portion positioned adjacent said wall.

2. The anchor of claim 1, further comprising a flexible from locking ridge positioned about the circumference of said from portion of said head and extending inwardly into said groove, said locking ridge shaped so as to lock said wire shelving within said groove.

3. The anchor of claim 2, further comprising a flexible rear locking ridge positioned about the circumference of said rear portion of said head and extending inwardly into said groove, said locking ridge shaped so as to lock said wire shelving within said groove.

4. A shelving system for attachment to a wall, said system comprising:

(a) a shelf comprising a plurality of interconnected wire members; and (b) at least one anchor for securing said shelf to said wall, said anchor comprising:

a spool-like head comprising a front portion, a rear portion, and an intermediate semi-circular arcuate groove extending about the entire circumference of said head, said anchor sized so that one of said wire members may be positioned within said arcuate groove of said anchor.

5. The shelving system of claim 4, wherein said threaded shank comprises a threaded portion and a drilling portion, said threaded portion positioned adjacent said front portion of said head, and wherein said anchor is self-drilling.

6. The anchor of claim 5 wherein said threaded portion comprises a cylindrical body having a continuous thread extending therefrom, said thread tapering in size in the direction from said front plate towards said drilling portion.

7. The anchor of claim 6, wherein said drilling portion comprises a flat blade extending from said cylindrical body, said blade having, at an end positioned distally of said body, a central guide point and a boring point on either side of said guide point.

8. The anchor of claim 5, wherein said bore comprises a phillips head recess extending through said head and at least partially through said cylindrical body.

9. The shelving system of claim 4, further comprising a shelving clip, said clip comprising:

(a) a head;

(b) a rod extending away from said head, said rod insertable in said bore;

(c) a lock tab extending tangentially away from said head above said rod, said tab having an arcuate recess on its underside , such that when said rod is inserted into said bore, said arcuate recess will be positioned directly above said arcuate groove.

10. An anchor for securing wire shelving to a wall, said anchor comprising:

a spool-like head comprising a front portion, a rear portion, and an intermediate semi-circular arcuate groove extending about the entire circumference of said head, such that a portion of said wire shelving may be secured in said groove, and a means for securing said head to a wall structure; further comprising a flexible rear locking ridge positioned about the circumference of said rear portion of said head and extending inwardly into said groove, said locking ridge shaped so as to lock said wire shelving within said groove.

11. The anchor of claim 10, further comprising a flexible front locking ridge positioned about the circumference of said front portion of said head and extending inwardly into said groove, said locking ridge shaped so as to lock said wire shelving within said groove.

12. The anchor of claim 10, wherein said rear portion of said head has a plurality of radially extending slits, said slits extending radially inward from the outer circumference of said rear portion towards said bore.

13. The shelving system of claim 4, further comprising an end bracket for securing a front end of said shelf to a vertically extending side wall, said end bracket comprising a rear support plate having at least one support aperture formed therein, and a fastener insertable in said support aperture, said fastener having a head larger in diameter than said support aperture, and said fastener securable to said side wall.

14. The shelving system of claim 13, wherein said fastener is self-drilling, and comprises:

(a) a drilling portion;

(b) a cylindrical body having a continuous thread extending therefrom, said body secured to said drilling portion;

(c) a head secured to said body at an end opposite said drilling tip; and (d) a phillips head recess extending through said head and a portion of said cylindrical body.

15. The shelving system of claim 4, further comprising a support brace for supporting the front edge of said shelf, said support brace comprising:

(a) a rigid brace member, and angularly disposed tab member attached at one end of said brace member, said tab member having at least one support aperture formed therein;

(b) at least one clip at the opposite end of said support brace, said clip attachable to the front end of said shelf; and (c) a fastener insertable in said support aperture, said fastener having a head larger in diameter than said support aperture, and said fastener securable to said side wall.

16. The shelving system of claim 15, wherein said fastener is self-drilling, and comprises:

(a) a drilling portion;

(b) a cylindrical body having a continuous thread extending therefrom, said body secured to said drilling portion;

(c) a head secured to said body at an end opposite said drilling tip; and (d) a phillips head recess extending through said head and a portion of said cylindrical body.

17. A support plate/fastener combination for attaching an apparatus to dry wall and similar substrates, said combination comprising:

(a) a self-drilling fastener comprising:

a drilling portion;

a cylindrical body having a continuous thread extending therefrom, said body secured to said drilling portion; and a head secured to said body at an end opposite said drilling tip;

and (b) a support plate having front and rear surfaces, a semi-circular support aperture communicating between said front and rear surfaces, and an arcuate bracing plate which extends into said support aperture, wherein said support aperture has a diameter less than that of the head of said fastener, and wherein the arc length of said bracing plate is selected so as to permit the thread of said fastener to freely rotate through said support aperture without interference from said bracing plate.

18. The combination of claim 17, wherein said bracing plate has a first interior curved surface positioned within said support aperture.

19. The combination of claim 18, wherein the curvature of said first interior surface of said bracing plate corresponds substantially to the curvature of said cylindrical body adjacent the head of said fastener.

20. A shelving system for attachment to a rear wall, said system comprising:

(a) a shelf comprising a plurality of interconnected wire members;

(b) at least one anchor for securing the rear edge of said shelf to said wall;

(c) a bracket for securing at least one of either the front edge of said shelf to said rear wall, or a front corner of said shelf to a side wall extending perpendicularly from said first wall; and (d) a self-drilling fastener comprising:

a drilling portion;

a cylindrical body having a continuous thread extending therefrom, said body secured to said drilling portion; and a head secured to said body at an end opposite said drilling tip;

wherein said bracket has a support plate having front and rear surfaces, a semi-circular support aperture communicating between said front and rear surfaces, and an arcuate bracing plate which extends into said support aperture, wherein said support aperture has a diameter less than that of the head of said fastener, and wherein the arc-length of said bracing plate is selected so as to permit the thread of said fastener to freely rotate through said support aperture without interference from said bracing plate, in order to secure said bracket to said front or rear walls.

21. The shelving system of claim 20, wherein said bracing plate has a first interior curved surface positioned within said support aperture.

22. The shelving system of claim 21, wherein the curvature of said first interior surface of said bracing plate corresponds substantially to the curvature of said cylindrical body adjacent the head of said fastener.

23. The shelving system of claim 20, wherein said bracket comprises a support brace for securing the front edge of said shelf to said rear wall, said support brace comprising a rigid brace member, having said support plate angularly disposed therefrom at one end, and at least one clip at the opposite end of said support brace, said clip attachable to the front end of said shelf, such that said support plate may be secured to said rear wall with said fastener in order to support the front edge of said shelf.

24. The shelving system of claim 20, wherein said bracket comprises an end bracket for securing a front corner of said shelf to said side wall, said end bracket comprising a said support plate, and floor member horizontally-extending from said support plate, such that when said support plate is secured to said side wall in a pre-selected location, the front corner of said shelf will be supported by said floor member.

25. The support plate/fastener combination of claim 17, wherein said fastener further comprises a phillips head recess extending through said head and a portion of said cylindrical body.

26. The support plate/fastener combination of claim 18, wherein said bracing plate further has a second interior curved surface positioned within said support aperture, wherein said first interior curved surface is angled inwardly from said front surface of said support plate, and said second interior curved surface is positioned perpendicular to said rear surface of said support plate.

27. The shelving system of claim 20, wherein said fastener further comprises a phillips head recess extending through said head and a portion of said cylindrical body.

28. The shelving system of claim 21, wherein said bracing plate further has a second interior curved surface positioned within said support aperture, wherein said first interior curved surface is angled inwardly from said front surface of said support plate, and said second interior curved surface is positioned perpendicular to said rear surface of said support plate.

* * * * *

UNITED STATES PATENT AND TRADEMARK OFFICE

CERTIFICATE OF CORRECTION

PATENT NO. : 5,626,245
DATED : May 6, 1997
INVENTOR(S) : Kokenge et al

It is certified that error appears in the above-indentified patent and that said Letters Patent is hereby corrected as shown below:

Claim 1, column 12, line 33, change "from" to --front--;

Claim 1, column 12, line 34, change "from" to --front--.

Signed and Sealed this

Twenty-fourth Day of June, 1997

Bruce Lehman

*Attest:*

BRUCE LEHMAN

*Attesting Officer*

*Commissioner of Patents and Trademarks*